US005377465A

United States Patent [19]

Kobori et al.

[11] Patent Number: 5,377,465

[45] Date of Patent: Jan. 3, 1995

[54] ULTRA-HIGH MULTI-STORY BUILDINGS AND CONSTRUCTION THEREOF

[75] Inventors: Takuji Kobori; Shigeru Ban; Toshihiko Kubota; Osamu Nohira; Norihide Koshika; Koji Kondo; Sadaaki Masuda; Yoshinori Kitamura; Hideo Tanaka; Hiroomi Sato; A. Scott Howe, all of Tokyo, Japan

[73] Assignee: Kajima Corporation, Tokyo, Japan

[21] Appl. No.: 820,887

[22] PCT Filed: Mar. 13, 1991

[86] PCT No.: PCT/JP91/00341

§ 371 Date: Mar. 18, 1992

§ 102(e) Date: Mar. 18, 1992

[87] PCT Pub. No.: WO91/18161

PCT Pub. Date: Nov. 28, 1991

[30] Foreign Application Priority Data

May 18, 1990 [JP] Japan ..... 2-128782
May 23, 1990 [JP] Japan ..... 2-132814

[51] Int. Cl.[6] ..... E04H 1/00
[52] U.S. Cl. ..... 52/236.3; 52/30
[58] Field of Search ..... 52/236.1–236.5, 52/30; 187/1 R

[56] References Cited

U.S. PATENT DOCUMENTS 3,659,387 5/1972 Pearson, Jr. .
3,791,093 2/1974 Finsterwalder ..... 52/236.2 X
4,434,595 3/1984 de Brabant ..... 52/236.2
4,656,799 4/1987 Maryon ..... 52/236.3

FOREIGN PATENT DOCUMENTS 1230543 9/1960 France .
292433 12/1990 Japan ..... 52/236.3

OTHER PUBLICATIONS

"The World's Tallest Building? Wait a Minute" Business Week, Aug. 25, 1986.
"Super Tall Buildings, the Sky is the Limit" ENR, Nov. 3, 1983.
"296 Meter High, Highest Multi-story Building in Japan, Designed to Beat a Wind Sway Problem" Nikkei Architecture, Jul. 9, 1990.
"New Umeda City Development Proposal Plan" Kenchiku Bunka, vol. 44, No. 510, Apr. 1, 1989.
"Television City, New York" Architecture and Urbanism, Jun., 1986.

*Primary Examiner*—Carl D. Friedman
*Assistant Examiner*—Beth A. Aubrey
*Attorney, Agent, or Firm*—Knobbe, Martens, Olson & Bear

[57] ABSTRACT

An extra super multi-story building having one piece of extra super multi-story of about 200 story construction, two pieces of extra super multi-stories of about 150 story construction and one piece of extra super multi-story of about 100 story construction. Each extra super multi-story includes two through four pieces of tower-like super multi-stories of about 50 story construction and of about 50 m in diameter (floor area: about 200 $m^2$/story). A sky lobby is provided about every 50 stories connecting the extra super multi-stories. Four shuttle elevators lead from the ground to the sky lobbies, and a sightseeing tower and high-rise garden (sky dome) are provided at the rooftop of the extra super multi-story building. Main facilities such as offices, hotels and residences are arranged in each extra multi-story. In addition, in order to be able to construct the extra super multi-story building, the individual extra super multi-story buildings are monolithically connected with one another by girders every several ten stories, and a space truss is constructed on the outside of each extra super multi-story building.

16 Claims, 6 Drawing Sheets

ULTRA-HIGH MULTI-STORY BUILDINGS AND CONSTRUCTION THEREOF

TECHNICAL FIELD

This invention relates to an extra super multi-story building of about 200 story construction and a structure hereof.

BACKGROUND ART

In recent years, the concentration of population in urban areas has become increasingly drastic, and in accordance with this, various urban problems have arisen. In particular, the shortage of the existing land has become acute.

Although various opinions are presented as reasons against building them, the usage of extra super multi-story buildings for the purpose of a higher utilization of land is desired.

In addition, in accordance with the recent rapid development of our information-oriented society, the capacity of buildings to accept computerized functions is in demand more than ever.

Additionally, a higher standard of living is desired by all, and one aspect is the number of activities and options available in and around our dwellings.

At present, super multi-story buildings have been constructed, but due to certain technical limitations only buildings with heights of as high as 100 stories have been built in most countries.

In Japan, the technical innovations for the construction of super multi-story buildings have been highly promoted, but since Japan is the world's foremost earthquake-prone country, the number of building stories cannot match those in other countries, and only super multi-story buildings having heights of as high as 75 stories have been attempted.

In addition, since most of the super multi-story buildings which are now under construction have limitations in the number of stories as well as floor areas, they are built only as exclusive buildings for office space and hotels. A super multi-story building which can function as a small town by equipping with facilities required for daily life has not yet been constructed.

The present invention has been developed in view of these circumstances, and it allows the construction of extra super multi-story buildings up to heights of as high as 200 stories. An object of the present invention is to provide extra super multi-story buildings and their structures which are equipped with facilities required to sustain urban life such as commercial facilities and sports facilities as well as offices, hotels and residences in one extra super multi-story building. Such an extra super multi-story building may be regarded as one small town.

SUMMARY OF THE INVENTION

In order to achieve the preceding object, the present invention comprises a plurality of extra super multi-stories of several hundred story construction constructed by setting up a plurality of tower-like super multi-stories of several ten story construction, a sky lobby provided every several ten stories connecting the extra super multi-stories so as to allow people to be able to go back and forth therebetween, a plurality of shuttle elevators provide the capability of going and returning to the sky lobby from the ground, and local elevators provide the capability of going back and forth to each story of each super multi-story in each extra super multi-story through the sky lobby.

In addition, in order to make it possible to construct this extra super multi-story building, the present invention is characterized in that a plurality of extra super multi-story buildings are constructed by setting up a plurality of tower-like super multi-stories of several ten story construction, and the extra super multi-story buildings are connected monolithically every several ten stories by means of girders.

BRIEF DESCRIPTION OF THE DRAWINGS

FIG. 1 is a perspective view of an extra super multi-story building;

FIG. 2 is a sectional view of FIG. 1;

FIG. 3 is a plan view of an entrance floor;

FIG. 4 is a plan view of a second floor;

FIGS. 6 and 7 are plan views of sky lobbies, respectively; and

FIGS. 5, 8 and 9 are plan views of each super multi-story, respectively.

Figure 1:
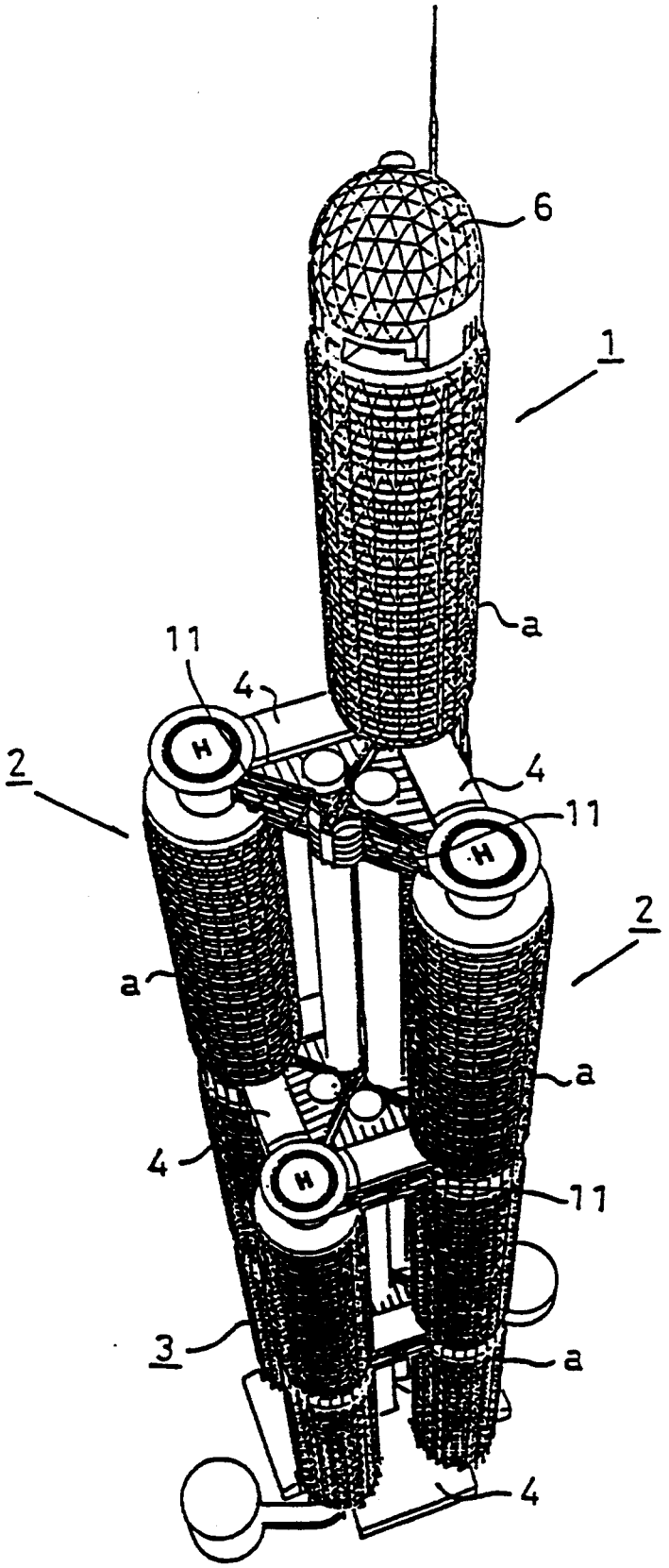
FIGS. 1 through FIG. 9 show one embodiment according to the present invention as follows.
Figure 2:
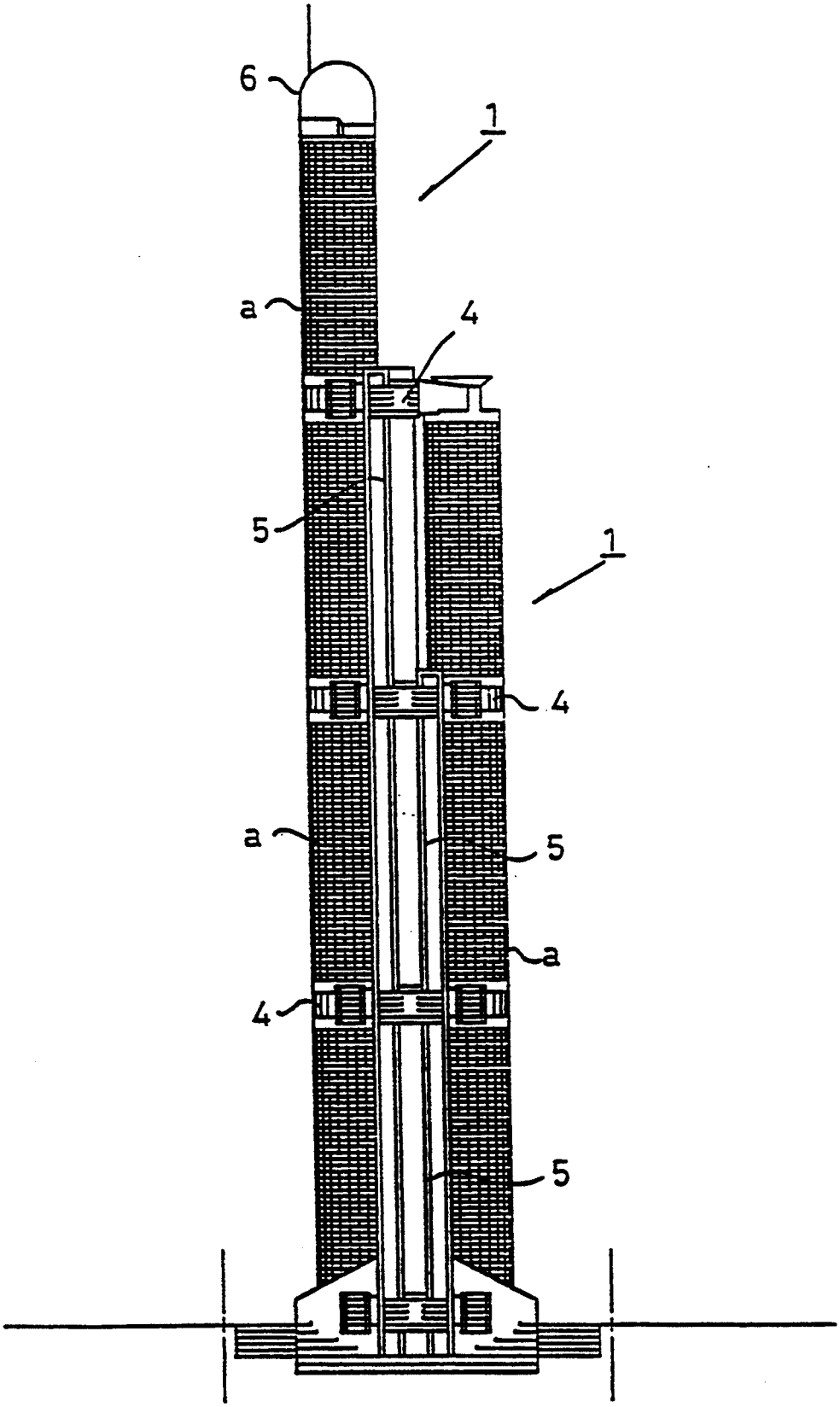

1, 2, 3—extra super multi-story; 4—sky lobby; 5—shuttle elevator; 6—sightseeing tower and high-rise garden (sky dome); 7—local elevator; 8—column; 9—beam; 10—space truss; 11—girder; a—super multi-story.

DESCRIPTION OF THE PREFERRED EMBODIMENTS

For the purpose of describing the present invention in detail, please refer to the attached drawings.

An extra super multi-story building of the present invention comprises one piece of extra super multi-story 1 of about 200 story construction, two pieces of extra super multi-stories 2 of about 150 story construction and one piece of extra super multi-story 3 of about 100 story construction constructed by setting up two through four pieces of tower-like super multi-stories a of about 200 story construction and of about 50 m in diameter (floor area is about 2,000 $m^2$/story). A sky lobby 4 is provided every 50 stories, in addition to four shuttle elevators 5, 5 leading to these sky lobbies 4, 4 from the ground, and a sightseeing tower and high-rise garden (sky dome) 6 at the rooftop of the extra super multi-story building 1.

Main facilities such as office, hotels and residences are arranged at each of the extra super multi-stories 1, 2 and 3. However, for example, if the portion up to 100 story construction is designated as offices, the portion of 100 through 150 story construction is designated as hotels (including residential area), and the portion up to the highest floor above the 150 story construction is designated as residences, it is possible to prevent the confusion of traffic lines and simultaneously to keep privacy.

The sky lobby 4 is a story which becomes a traffic contact point between the respective extra super multi-stories 1, 2 and 3, and it is constructed to about 5 or 6 stories. The lowest floor is constructed as a floor only for service and the remaining floors are constructed for general guests including an emergency floor. For example, commercial facilities such as stores and restaurants, cultural facilities such as library and art museum, sports facilities such as athletic fields and swimming pools, sightseeing facilities, heliports and other necessary facilities for urban life can be provided on the floor only for services and the floor for general guests (refer to FIGS. 3, 4, 6 and 7).

Figure 3:
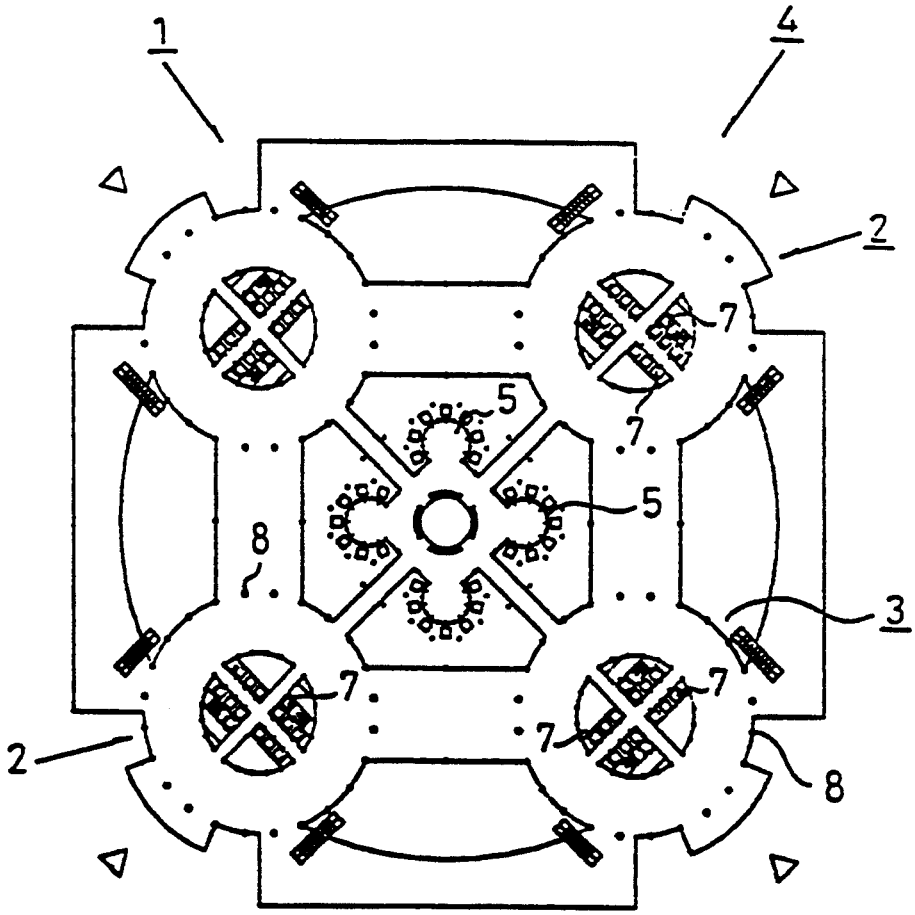
Figure 4:
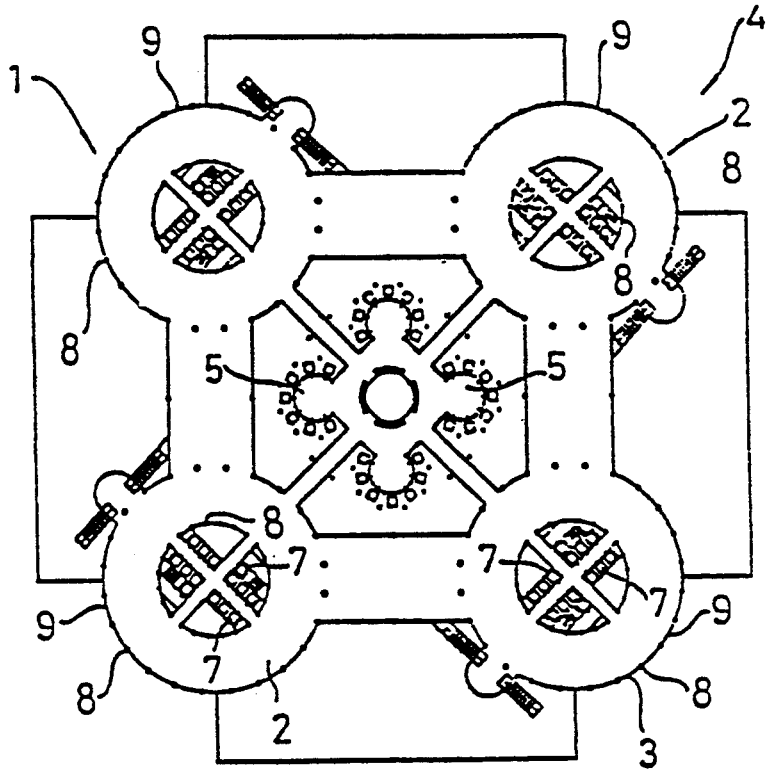
Figure 5:
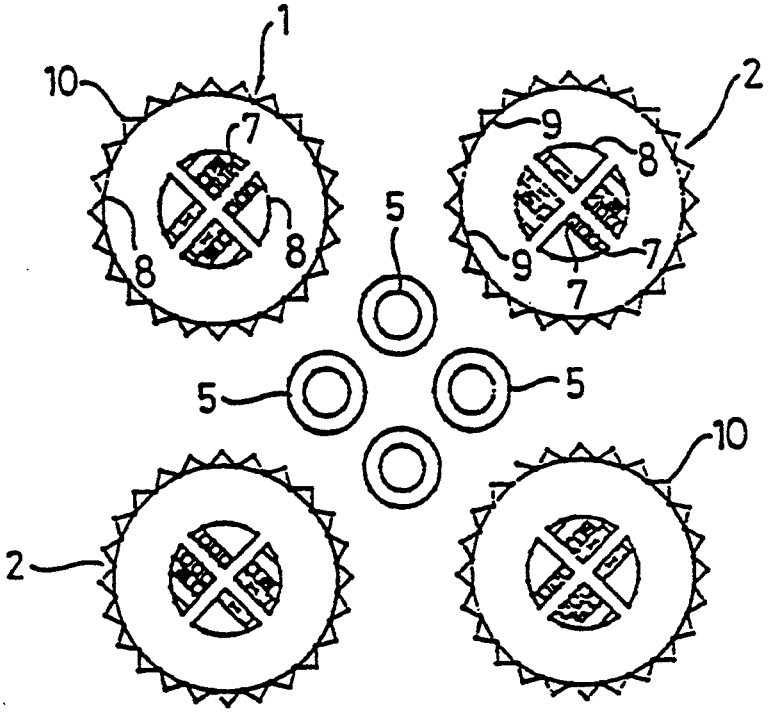
Figure 6:
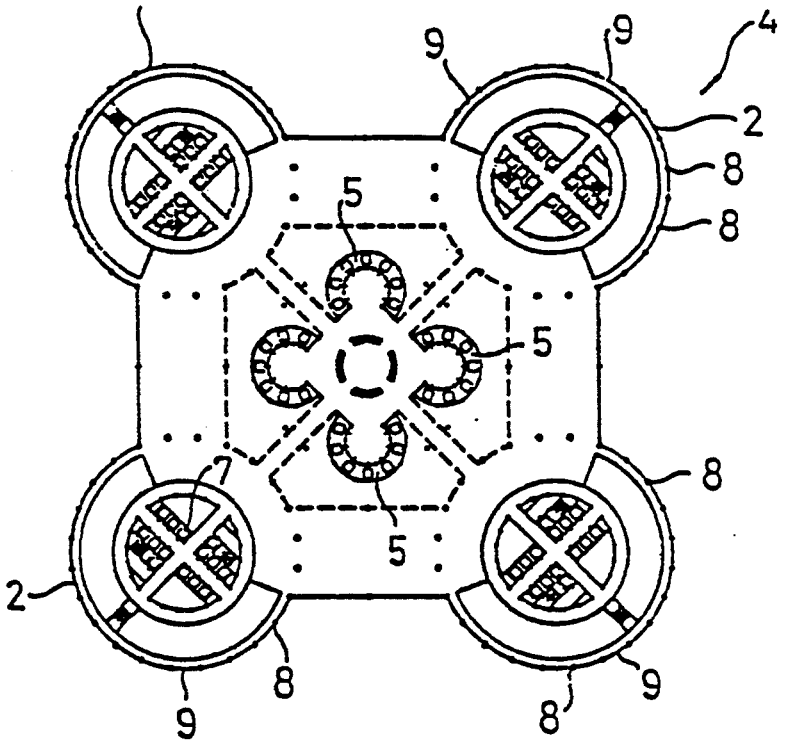
Figure 7:
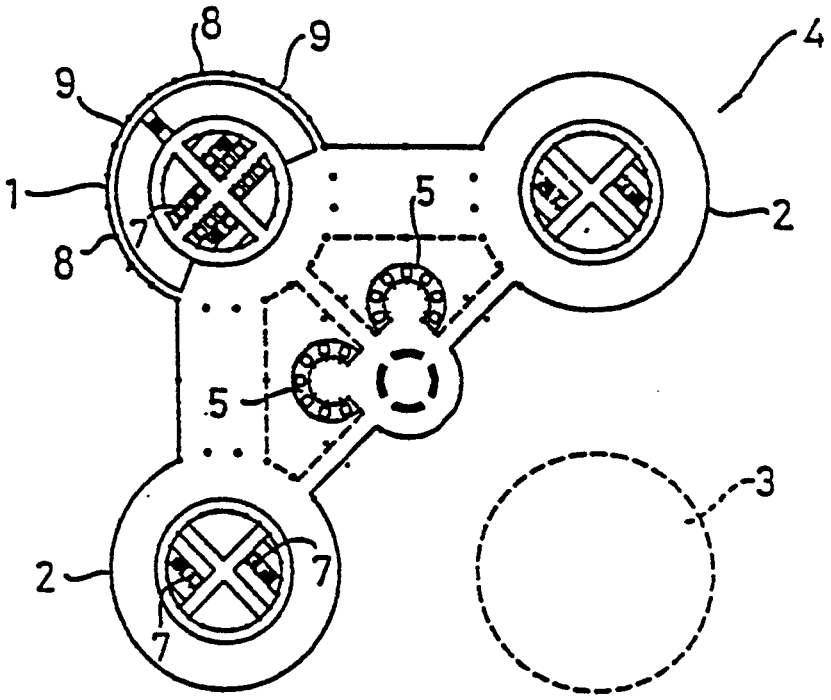
Figure 8:
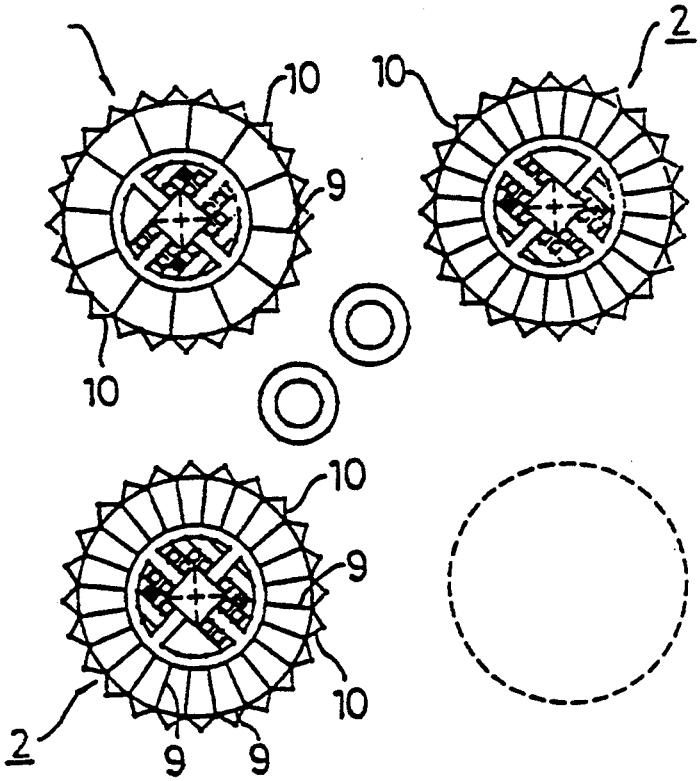
Figure 9:
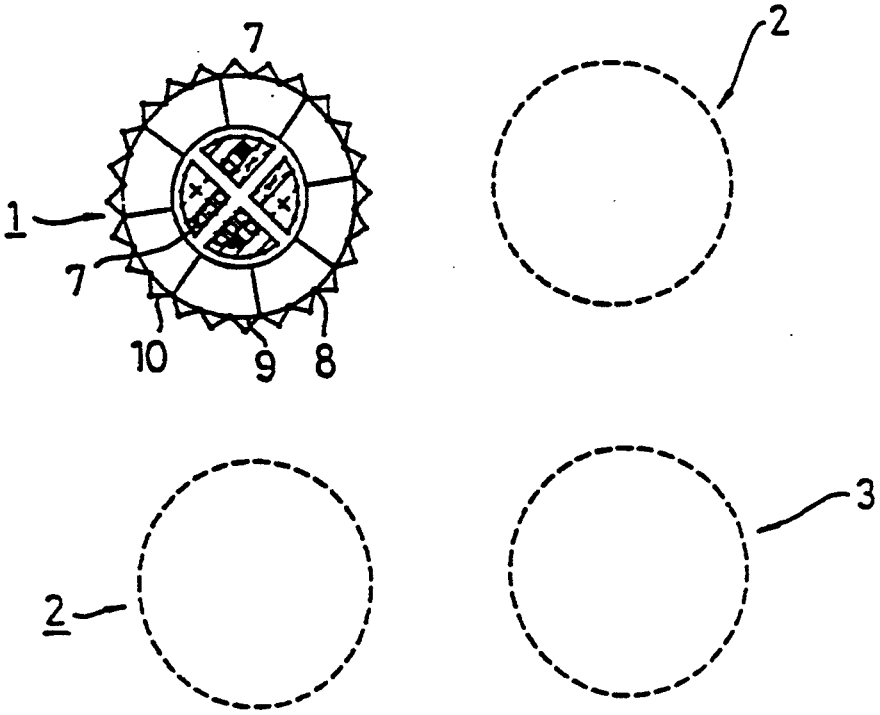

In addition, the facilities necessary for urban life such as commercial facilities are also provided on the floors close to both basement floors and floors above the ground as occasion demands, similar to those in the sky lobby 4 (refer to FIGS. 3 and 4).

The shuttle elevators 5, 5 are main elevators in this building, and a plurality of local elevators 7, 7 are also provided in each of the extra super multi-stories 1, 2 and 3 so as to be capable of going back and forth to each floor of each super multi-story a from the sky lobby 4.

On the basis of such a plan, it is possible to get to each floor of each super multi-story a by riding on the shuttle elevator 5 from the ground to get to the nearest sky lobby 4 and then changing to the local elevator 7 in each of the extra super multi-stories 1, 2 and 3.

In addition, it is possible to substantially lead daily life without going outside using the facilities such as stores available in the sky lobby 4 and on the floors nearest to both the basement floors and the floors above the ground.

Moreover, since extra super multi-story buildings cannot avoid experiencing high stresses once an earthquake happens, it is possible to construct the extra super multi-story buildings using high-strength materials.

Of all these things, an extremely high rigid steel pipe concrete column is used for columns 8 of each extra super multi-story 1, 2 or 3, and the columns 8 are fitted to the inside and the outside of each extra super multi-story at circumferential intervals.

The amount of cast-in-place concrete is decreased to a minimum and, at the same time, the assembly time is shortened by placing most of the concrete of the column 8 prior to the erection and then by placing only a portion of concrete in site for joint portions or the like which are necessary to design.

Steel beams are used for the beam 9 of each extra super multi-story 1, 2 or 3, and the steel beams 9 are erected along the circumferential direction of each extra super multi-story 1, 2 or 3 on every floor between inner columns 8, 8 and between outer columns 8, 8 or radially between the inner column 8 and the outer column 8, respectively.

Moreover, at the outside of the outer column 8 of each extra super multi-story 1, 2 or 3, a space truss 10 is constructed over the whole circumference of each extra super multi-story 1, 2 or 3, and thus the rigidity of the circumferential surface of each extra super multi-story 1, 2 or 3 is greatly increased by such a construction.

Furthermore, each super multi-story 1, 2 or 3 is monolithically connected with one another every 50 stories by a girder 11 composed of large type trussed beams or the like, and thus the horizontal rigidity of the overall building is greatly increased by such a construction and, at the same time, the safety of the overall building is intended by installing various seismic response control devices using the girder 11.

The floor of each story in each extra super multi-story 1, 2 or 3 is constructed using composite floor plywoods, and the reduction of the amount of the cast-in-place concrete and the light weight of floor load are obtained by such a construction.

The simplification and omission of external wall work and further the shortening of assembly time are realized by totally constructing the external walls of each extra super multi-story 1, 2 or 3 by means of curtain wall.

In addition, an improvement of assembly efficiency is obtained by lifting, with aid of a lift or the like, the curtain wall to the floor to be set up so as to avoid inconveniences in the erection of framing, thus using a fitting machine only for curtain wall in fitting work, and further, by adopting a large-type unit method, but not a so-called "knock-down method."

UTILIZATION IN INDUSTRIES

As described above, the extra super multi-story buildings and their structures according to the present invention can eliminate the problems of land shortage, contribute to the rapid development of information-oriented society, and further, provide a great contribution to the improvements of both residential environment and urban environment.

We claim:

1. An extra super multi-story building comprising:
   - a plurality of extra super multi-story towers of between one and two-hundred story construction each constructed by stacking a plurality of tower-like super multi-stories of about fifty story construction;
   - a sky lobby provided every fifty stories connecting said extra super multi-story towers at elevations between said tower-like super multi-stories to enable travel between said extra super multi-story towers;
   - a plurality of shuttle elevators leading from the ground to the sky lobbies; and
   - local elevators leading from the sky lobbies to floors between the sky lobbies and provided in each extra super multi-story tower.

2. An extra super multi-story building according to claim 1, wherein main facilities such as offices, hotels and residences are provided in each tower-like super multi-story, and the facilities required to sustain urban life such as commercial facilities, cultural facilities and sports facilities are provided in an entrance lobby and at least one of the sky lobbies.

3. An extra super multi-story building as in claim 1, wherein said extra super multi-story towers are monolithically connected with each other by a girder every fifty stories at the elevations of said sky lobbies.

4. An extra super multi-story building according to claim 3, wherein supporting columns of each extra super multi-story tower are of steel pipe concrete construction.

5. A structure of an extra super multi-story building according to claim 3 or 4, wherein a space truss is constructed at the outside of each extra super multi-story building.

6. An extra super multi-story building according to claim 3, wherein composite floor plywoods are used in the construction of floors in each extra super multi-story tower to decrease the amount of cast in place concrete and reduce the floor weight.

7. An extra super multi-story building according to claim 3, wherein curtain walls are used for constructing the external walls of each extra super multi-story tower to decrease the assembly time.

8. An extra super multi-story building according to claim 4, wherein the supporting columns of the steel pipe concrete construction have the concrete precast to minimize the assembly time of the extra super multi-story building.

9. An extra super multi-story building according to claim 4, wherein the supporting columns of each extra super multi-story tower are placed at circumferential intervals around the inside and the outside of each extra super multi-story tower.

10. An extra super multi-story building according to claim 9, further including steel beams erected along the circumferential direction between either inner columns or outer columns or radially between the inner columns and outer columns.

11. An ultra-high, multi-story building, comprising: a plurality of at least three ultra-high, multi-story towers, said towers being disposed adjacent one another but substantially independent from each other, each of said ultra-high, multi-story towers comprised of a plurality of vertically aligned and stacked super multi-story subtowers of between ten and fifty story construction and of equal height to one another such that each subtower of one of said towers is horizontally disposed adjacent a corresponding subtower of equal height to an adjacent tower, each of said subtowers being horizontally connected to the corresponding subtower of said adjacent towers in at least one location to permit passage of tower occupants from one tower to said adjacent tower; and a plurality of girders monolithically connecting said multi-story towers with each other every ten to fifty stories at elevations between said subtowers in each respective multi-story tower.

12. The ultra-high, multi-story building of claim 11, wherein each of said subtowers is about 50 stories.

13. The ultra-high, multi-story building of claim 11, wherein said horizontal connections between adjacent towers comprise ski lobbies disposed at the top of each of said subtowers to permit passage of tower occupants from one tower to said adjacent tower.

14. The ultra-high, multi-story building of claim 11, wherein said building is constructed over substantially its whole circumferential area with a space truss.

15. The ultra-high, multi-story building of claim 11, wherein said horizontal connections comprise a large-type truss beam construction.

16. An ultra-high, multi-story building, comprising:

a plurality of at least three ultra-high, multi-story towers, said towers being disposed adjacent one another and arranged about the periphery of an open central space, each of said ultra-high, multi-story towers comprised of a plurality of vertically aligned and stacked super multi-story subtowers of equal height to one another, each of said subtowers being horizontally connected to the corresponding subtower of an adjacent tower in at least one location;

at least one express elevator disposed in said open central space for passage of occupants from the ground to the uppermost regions of said building; and at least one local elevator disposed in each of said subtowers.

* * * * *